US008303338B2

(12) United States Patent
Chen

(10) Patent No.: US 8,303,338 B2
(45) Date of Patent: Nov. 6, 2012

(54) GROUNDING ELECTRICAL CONNECTOR

(75) Inventor: Han-Chung Chen, Taipei (TW)

(73) Assignee: EZConn Corporation, Taipei (TW)

( * ) Notice: Subject to any disclaimer, the term of this patent is extended or adjusted under 35 U.S.C. 154(b) by 88 days.

(21) Appl. No.: 13/071,898

(22) Filed: Mar. 25, 2011

(65) Prior Publication Data

US 2012/0244747 A1 Sep. 27, 2012

(51) Int. Cl.
*H01R 9/05* (2006.01)

(52) U.S. Cl. ..... 439/583; 439/578

(58) Field of Classification Search ..... 439/578, 439/583, 584, 585

See application file for complete search history.

(56) References Cited

U.S. PATENT DOCUMENTS

| | | | | |
|---|---|---|---|---|
| 7,354,307 | B2 * | 4/2008 | Chee et al. | 439/584 |
| 7,785,144 | B1 * | 8/2010 | Islam | 439/583 |
| 7,892,024 | B1 * | 2/2011 | Chen | 439/578 |
| 8,100,717 | B2 * | 1/2012 | Amidon | 439/587 |

* cited by examiner

*Primary Examiner* — Hien Vu

(74) *Attorney, Agent, or Firm* — Rosenberg, Klein & Lee

(57) ABSTRACT

A grounding electrical connector includes: an inner sleeve and an outer sleeve coaxially positioned around the inner sleeve, the inner sleeve serving to receive the central conductor and the insulator of the cable, the outer sleeve serving to receive the external conductor and the skin of the cable, the inner sleeve having an outer flange, an interface section, a tapered section positioned between the outer flange and the interface section, and a rear end extension section; a nut having an inner flange positioned around the tapered section of the inner sleeve; and a C-shaped contact spring back and forth movably arranged around the tapered section of the inner sleeve in contact with the nut. The C-shaped contact spring is back and forth movable to keep the nut in contact with the inner sleeve so as to achieve good grounding effect.

1 Claim, 4 Drawing Sheets

GROUNDING ELECTRICAL CONNECTOR

BACKGROUND OF THE INVENTION

1. Field of the Invention

The present invention relates generally to a connector, and more particularly to an electrical connector with grounding effect.

2. Description of the Related Art

A conventional coaxial cable connector is connectable to an interface connector for electrically connecting a coaxial cable to an electronic device.

When connecting a coaxial cable connector with a coaxial cable, it must be ensured that the external conductor of the coaxial cable is in good contact with the connector for transmission of electrical signals. The conventional coaxial cable connector has some shortcomings. For example, it takes place sometimes that the conventional coaxial cable connector is not truly grounded to lead to interruption of signal transmission. FIG. 1 shows an F-type connector as a typical coaxial cable connector. The F-type connector 10 includes an inner sleeve 11, an outer sleeve 12 coaxially arranged around the inner sleeve 11, and a nut 13. The rear end of the nut 13 is formed with an inner flange 14 rotatably sandwiched between the inner and outer sleeves 11, 12.

When connecting the connector 10 with a free end of a coaxial cable 15, the free end of the coaxial cable 15 is inserted into the connector 10, wherein the central conductor 16 and the insulator 17 of the coaxial cable 15 are positioned in the inner sleeve 11, while the external conductor 18 and the skin 19 of the coaxial cable 15 are positioned between the inner and outer sleeves 11, 12.

When using the connector 10 to connect the coaxial cable 15 with an electronic device 1, the nut 13 is screwed onto a threaded interface connector 2 of the electronic device 1 so as to electrically connect the central conductor 16 of the coaxial cable 15 with the electronic device 1.

In case the nut 13 is not fully locked with the threaded interface connector 2, the nut 13 may fail to well contact with the inner sleeve 11. This will lead to poor transmission of electrical signals or interruption thereof.

It is therefore tried by the applicant to provide an electrical connector, in which the nut is kept in good grounding contact with the inner sleeve to achieve good electrical performance.

SUMMARY OF THE INVENTION

It is therefore a primary object of the present invention to provide a grounding electrical connector including an inner sleeve and a C-shaped contact spring back and forth movably arranged around the inner sleeve. The C-shaped contact spring serves to keep the nut of the grounding electrical connector in secure grounding contact with the inner sleeve to ensure good signal transmission quality and electrical performance.

To achieve the above and other objects, the grounding electrical connector of the present invention includes: an inner sleeve and an outer sleeve coaxially positioned around the inner sleeve, the inner sleeve serving to receive the central conductor and the insulator of the cable, the outer sleeve serving to receive the external conductor and the skin of the cable, the inner sleeve having an outer flange, an interface section, a tapered section positioned between the outer flange and the interface section, and a rear end extension section; a nut having an inner flange positioned around the tapered section of the inner sleeve; and a C-shaped contact spring back and forth movably arranged around the tapered section of the inner sleeve in contact with the nut. The C-shaped contact spring is back and forth movable to keep the nut in contact with the inner sleeve so as to achieve good grounding effect.

The present invention can be best understood through the following description and accompanying drawings, wherein:

DETAILED DESCRIPTION OF THE PREFERRED EMBODIMENT

Figure 1:
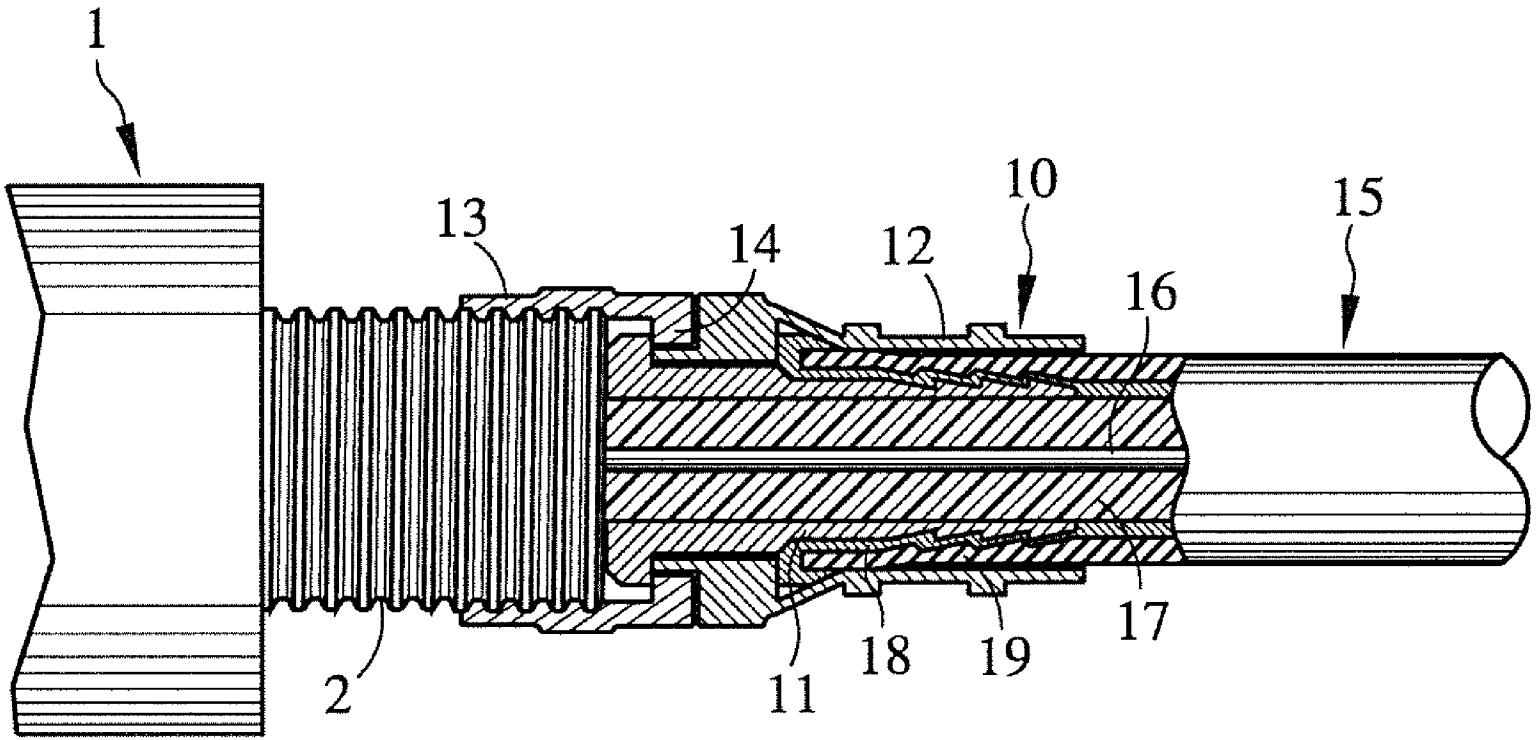
FIG.1 PRIOR ART
FIG. 1 is a sectional view showing that a conventional grounding electrical connector is connected with a coaxial cable and is to be installed to an electronic device.
Figure 2:
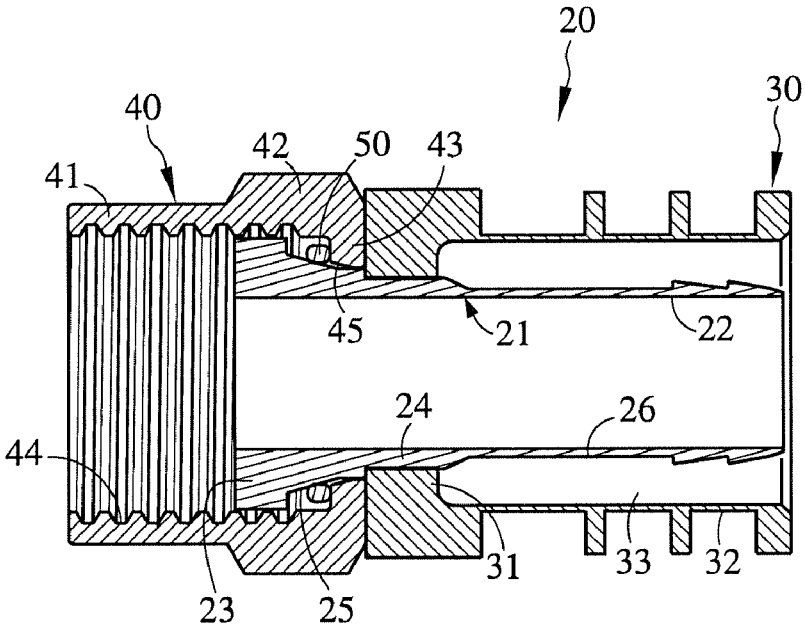
FIG. 2 is a sectional view of the grounding electrical connector of the present invention.
Figure 3:
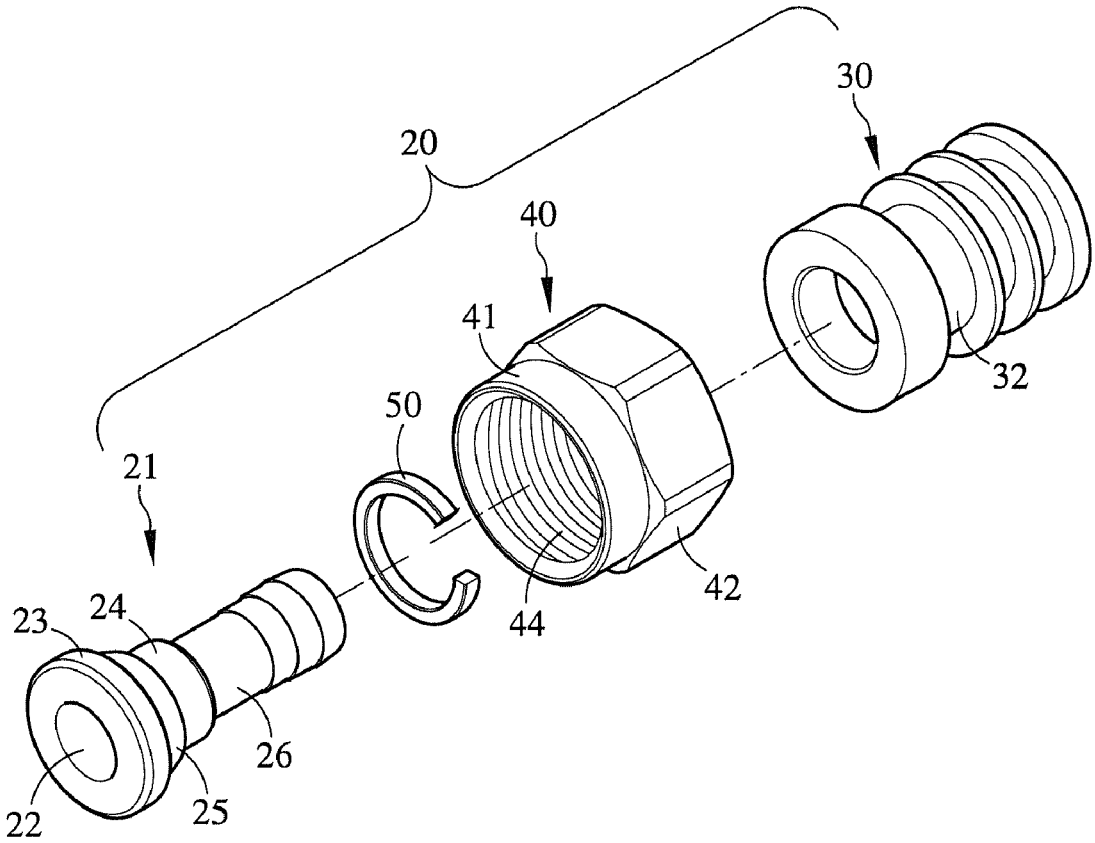
FIG. 3 is a perspective exploded view of the grounding electrical connector of the present invention.

Please refer to FIGS. 2 and 3. FIG. 2 is a sectional view of the grounding electrical connector of the present invention, while FIG. 3 is a perspective exploded view of the grounding electrical connector of the present invention. The same components are denoted with the same reference numerals. The grounding electrical connector 20 of the present invention includes an inner sleeve 21, an outer sleeve 30, a nut 40 and a C-shaped contact spring 50.

Figure 4A:
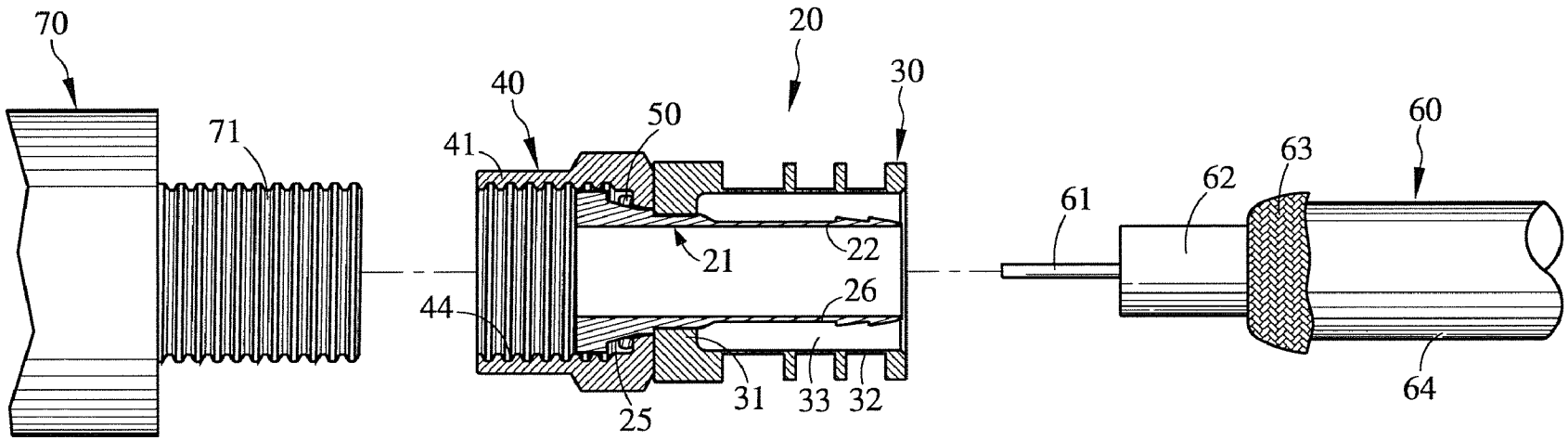
FIGS. 4A to 4C show the steps of installation process of the grounding electrical connector of the present invention to the electronic device.
Figure 4B:
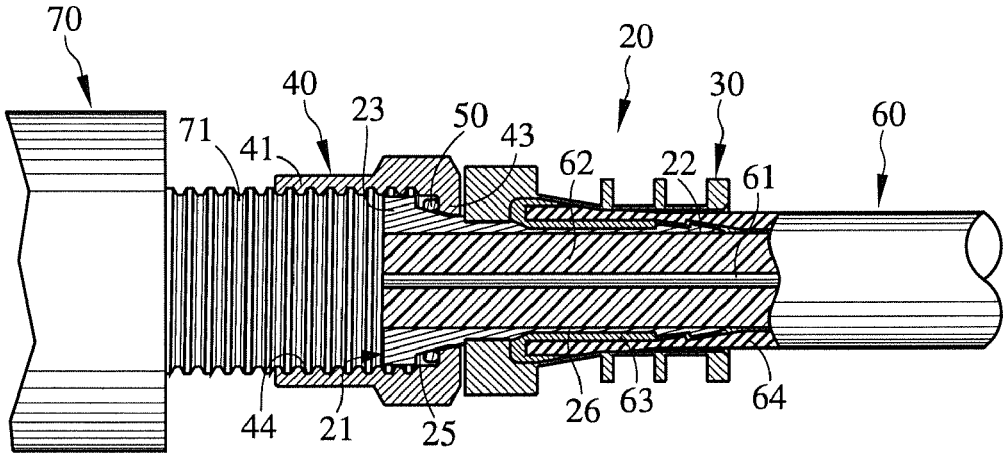

The inner sleeve 21 has a passageway 22 for receiving therein a central conductor 61 and an insulator 62 of a coaxial cable 60 (as shown in FIG. 4B). The inner sleeve 21 further has an outer flange 23 formed at front end of the inner sleeve 21, an interface section 24, a tapered section 25 positioned between the outer flange 23 and the interface section 24, and a rear end extension section 26.

The outer sleeve 30 has an inner flange 31 positioned around the interface section 24 and a rear end extension section 32 coaxially positioned around the rear end extension section 26 of the inner sleeve 21. The rear end extension section 32 of the outer sleeve 30 and the rear end extension section 26 of the inner sleeve 21 define an annular hollow 33 for receiving therein an external conductor 63 and the skin 64 of the coaxial cable 60 (as shown in FIG. 4B).

Figure 4C:
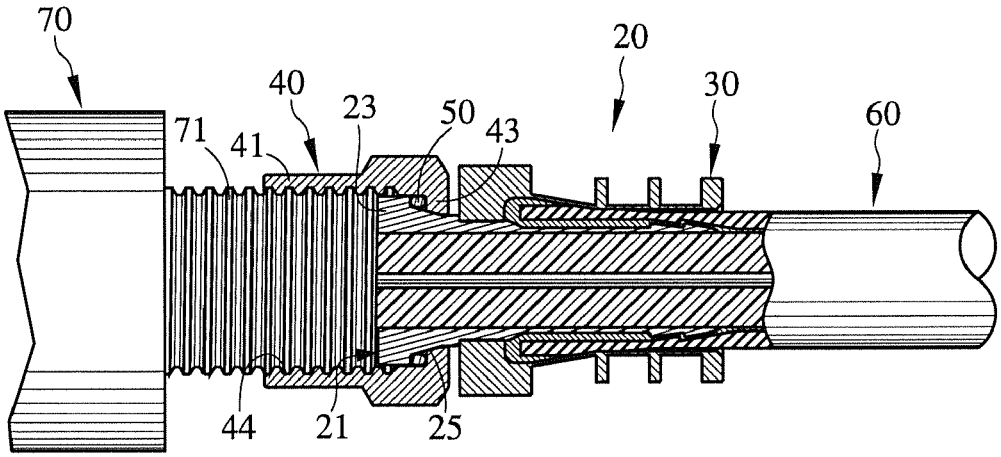

The nut 40 is positioned at front end of the grounding electrical connector 20. The nut 40 includes an annular hub section 41, a hexagonal body section 42 and an inner flange 43 formed at a rear end of the nut 40 and rotatably disposed around the tapered section 25 of the inner sleeve 21. The annular hub section 41 is formed with a threaded hole 44 for locking and mechanically and electrically connecting the nut 40 on a threaded interface connector 71 of an electronic device 70 (as shown in FIG. 4C). The inner flange 43 defines a tapered hole 45, whereby the nut 40 can be moved back and forth along the tapered section 25 of the inner sleeve 21.

The C-shaped contact spring 50 is arranged around the tapered section 25 of the inner sleeve 21 in good contact with the inner flange 43 of the nut 40. Accordingly, it is ensured that the nut 40 is effectively and lastingly in grounding contact with the inner sleeve 21 to achieve good electrical performance.

The C-shaped contact spring 50 is back and forth movably disposed around the tapered section 25 of the inner sleeve 21 and keeps in contact with the nut 40. Therefore, even if the nut 40 is not fully locked with the threaded interface connector 71, the C-shaped contact spring 50 is back and forth movable to keep the nut 40 in contact with the inner sleeve 21 and achieve good grounding effect.

FIGS. 4A to 4C show the steps of the installation process of the grounding electrical connector 20 to the threaded interface connector 71 of the electronic device 70. Prior to installation, it is necessary to first remove a part of the skin 64 of the free end of the coaxial cable 60 and fold back the external conductor 63 to expose the insulator 62 and the central conductor 61. After the free end of the cable 60 is prepared, the free end of the cable 60 is inserted into the grounding electrical connector 20. When inserted, the rear end extension section 26 of the inner sleeve 21 is forcedly thrust between the insulator 62 and the external conductor 63 of the cable 60. After the cable 60 is connected with the grounding electrical connector 20, the grounding electrical connector 20 is used to connect the coaxial cable 60 with the electronic device 70 as shown in FIG. 4A.

The nut 40 is rotated to screw the threaded interface connector 71 into the threaded hole 44 of the annular hub section 41 as shown in FIG. 4B. During rotation, the C-shaped contact spring 50 is pushed by the inner flange 43 to move forward until the nut 40 is fully tightened with the interface connector 71. At this time, the C-shaped contact spring 50 is moved from a position of rear end of the tapered section 25 to a position of front end of the tapered section 25 and positioned between the outer flange 23 and the inner flange 43. In this case, the nut 40 is in grounding contact with the inner sleeve 21 as shown in FIG. 4C.

Figure 5:
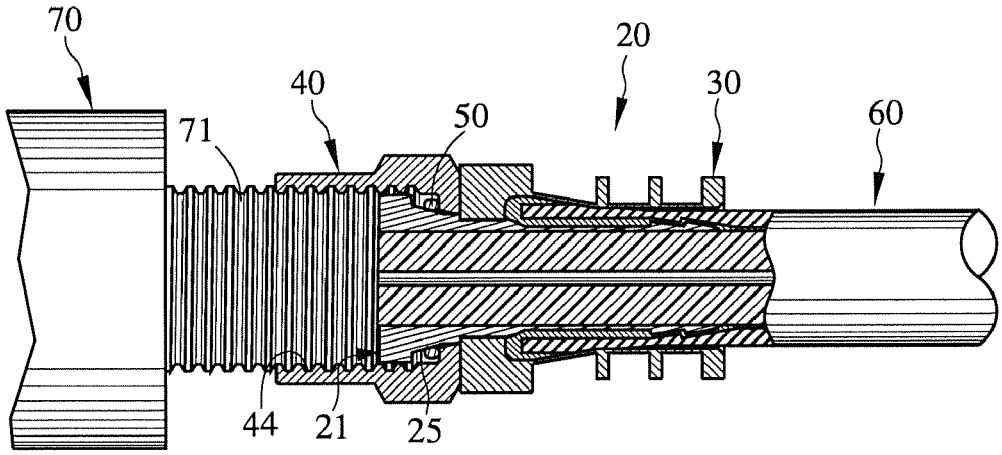
FIG. 5 is a sectional view showing that the nut of the grounding electrical connector of the present invention is loosened from the threaded interface connector of the electronic device and the C-shaped contact spring keeps the nut in grounding contact with the inner sleeve.

As shown in FIG. 5, in case the nut 40 is loosened (unscrewed) from the threaded interface connector 71 due to circumferential or external factors, the C-shaped contact spring 50 will move rearward with the displacement of the nut 40 to keep in contact therewith. Therefore, no matter whether the nut 40 is fully locked with the threaded interface connector 71 or loosened from the threaded interface connector 71, the C-shaped contact spring 50 is back and forth movable to keep the nut 40 in contact with the inner sleeve 21 and achieve good grounding effect so as to ensure good signal transmission quality and electrical performance.

The above embodiment is only used to illustrate the present invention, not intended to limit the scope thereof. Many modifications of the above embodiment can be made without departing from the spirit of the present invention.

What is claimed is:

1. A grounding electrical connector for mechanically and electrically connecting a coaxial cable with a threaded interface connector of an electronic device, the cable including a central conductor, an insulator enclosing the central conductor, at least one external conductor disposed around the insulator, and a skin coated on the external conductor, the connector comprising:

a conductive inner sleeve and a conductive outer sleeve coaxially positioned around the inner sleeve, the inner sleeve serving to receive the central conductor and the insulator of the cable, the outer sleeve serving to receive the external conductor and the skin of the cable, the inner sleeve having an outer flange formed at front end of the inner sleeve, an interface section, a tapered section positioned between the outer flange and the interface section, and a rear end extension section;

a nut having an inner thread rotatably connected with an outer threaded interface connector of an electronic device, the nut having an inner flange formed at rear end of the nut and positioned around the tapered section of the inner sleeve, the inner flange defining a hole having a tapered surface in which the tapered section of the inner sleeve is aligned with the tapered surface; and a C-shaped conductive contact spring positioned between the outer flange and inner flange, and being back and forth movably arranged around the tapered section of the inner sleeve in contact with the inner flange of the nut, whereby the C-shaped contact spring is back and forth movable to keep the nut in contact with the inner sleeve as the nut is moved axially along the inner sleeve so as to achieve good grounding effect.

* * * * *